United States Patent [19]

Petro

[11] 4,058,135

[45] Nov. 15, 1977

[54] COMPENSATED WORK PORT FLUID VALVES AND WORK PORT COMPENSATORS

[75] Inventor: John D. Petro, Youngstown, Ohio

[73] Assignee: Commercial Shearing, Inc., Youngstown, Ohio

[21] Appl. No.: 751,203

[22] Filed: Dec. 16, 1976

Related U.S. Application Data

[62] Division of Ser. No. 547,410, Feb. 6, 1975.

[51] Int. Cl.[2] ..... F15B 13/04

[52] U.S. Cl. ..... 137/106; 91/447; 137/596

[58] Field of Search ..... 91/447; 137/596, 596.12, 137/102, 106

[56] References Cited

U.S. PATENT DOCUMENTS

| | | | |
|---|---|---|---|
| 3,532,119 | 10/1970 | Lind | 137/596 |
| 3,565,110 | 2/1971 | Hodgson | 137/596.12 |
| 3,730,219 | 5/1973 | Tennis | 137/596 |
| 3,903,786 | 9/1975 | Walters | 91/447 X |
| 3,951,162 | 4/1976 | Wilke | 91/447 X |

*Primary Examiner*—Alan Cohan
*Assistant Examiner*—Gerald A. Michalsky
*Attorney, Agent, or Firm*—Buell, Blenko & Ziesenheim

[57] ABSTRACT

A compensated work port fluid valve is provided wherein a directional control valve having an inlet chamber, an outlet chamber and a work chamber is provided with a compensator valve connected to the work chamber and having a pressure sensing compensator valve controlling the flow of fluid from the work chamber to a work port to maintain constant pressure at the work port.

4 Claims, 4 Drawing Figures

COMPENSATED WORK PORT FLUID VALVES AND WORK PORT COMPENSATORS

This invention relates to compensated work port fluid valves and to work port compensators and particularly to a work port compensator valve which may be combined with the outlet port of a conventional directional control valve to provide pressure compensation to the valve combination.

Pressure compensation of directional control valves is not new and has been provided in a variety of forms and configurations. Heretofore, however, pressure compensation has primarily been carried out by providing a special inlet section coupled with a modified form of directional control valve configuration. Typical of such prior art valve combinations are those illustrated in Hodgson U.S. Pat. No. 3,565,110, Strample U.S. Pat. No. 3,602,104, Holt U.S. Pat. No. 3,602,243, Rice et al. U.S. Pat. No. 3,255,777 and Allen U.S. Pat. No. 3,234,957. All of these structures are designed to supply a constant volume of fluid, however, none of these structures can be adapted to standard closed center or open center directional control valves. The present invention provides a valve element for use at the work port of conventional closed center or open center directional control valves for self compensation of the valve with but slight modification of the directional control valve.

In my invention I provide a housing having an inlet port adapted to communicate with the work port of a directional control valve and a spaced apart work port, at least one bore between the inlet port and work port, an inlet chamber intersecting said bore, a spaced apart outlet chamber intersecting said bore, a valve member slidable in said bore resilient means at one end normally biasing the valve member toward the inlet chamber to prevent communication between the outlet and inlet chambers, a first signal passage from the inlet port to the bore at the resilient means to pressurize one end of said valve member and second signal passage communicating between the bore at the other end of said valve member and the inlet of the valve being compensated whereby the position of the valve member is controlled by the pressure differential between first and second signal passages. A second bore may be provided generally parallel to the bore and intersecting both outlet and inlet chambers and provided with anti-cavitation valve means. Alternatively, a relief check may be incorporated in the valve member to permit flow in the opposite direction.

In the foregoing general description I have set out certain objects, purposes and advantages of my invention. Other objects, purposes and advantages of this invention will be apparent from a consideration of the following description and the accompanying drawings in which.

Figure 1:
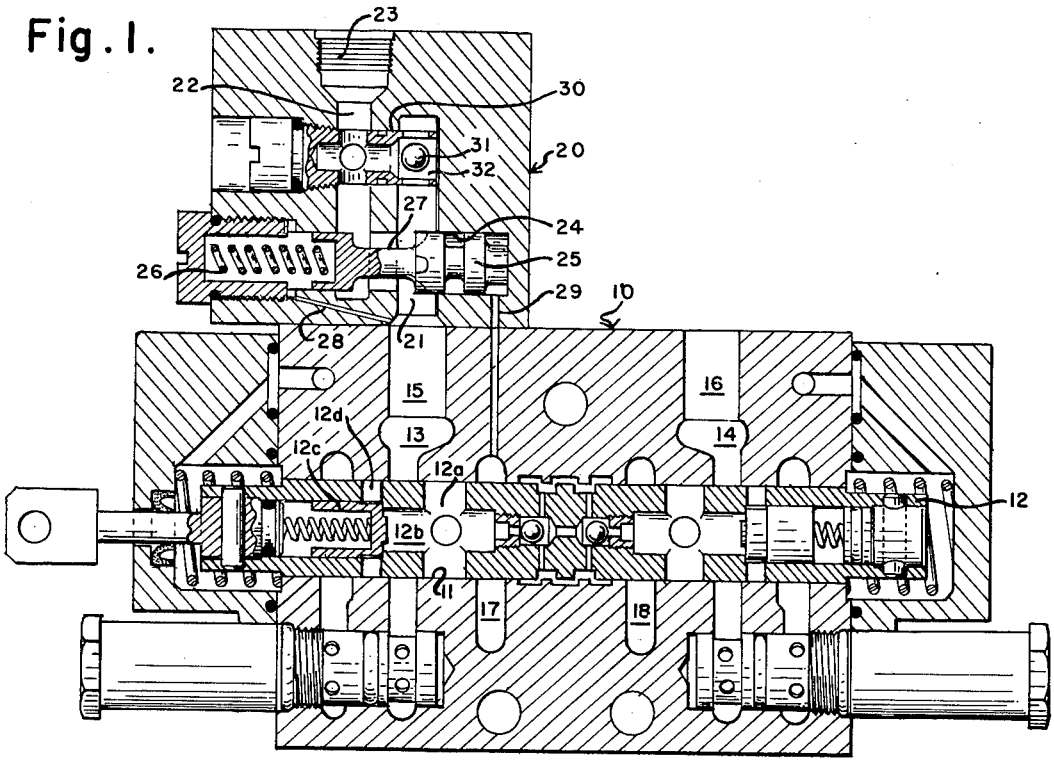
FIG. 1 is a sectional view of a compensator according to this invention combined with a closed center valve of conventional configuration.

Referring to the drawings I have illustrated a conventional closed center valve having a valve body 10 with a bore 11 carrying a valve member 12. Work chambers 13 and 14 intersect bore 11 at opposite ends of the housing and communicate with work ports 15 and 16. Parallel high pressure chambers 17 and 18 intersect the bore 11 and communicate with a source of high pressure fluid. Compensator housing 20 is fixed to housing 10 by bolts (not shown). Compensator housing 20 has an inlet chamber 21 communicating with work port 15 and a spaced outlet chamber 22 communicating with a threaded work port 23. A bore 24 extends through both chambers 21 and 22 and carries valve member 25 slidable therein. Valve member 25 is biased toward inlet chamber 21 by spring 26. An annular groove 27 is provided in valve member 25. A first signal passage 28 in housing 20 connects inlet chamber 21 with bore 24 at the end carrying spring 26. A second signal passage 29 connects high pressure chamber 17 to the end of bore 24 so that the pressure in chamber 17 is applied to the end of valve member 25.

The operation of the valve structure described above is as follows: The control valve member 12 is shown in FIG. 1 in the neutral position. When member 12 is shifted to the right, high pressure fluid in passage 17 flows through radial passage **12*a*, axial bore 12*b* through check 12*c* and out radial passage 12*d* into work chamber 13 from which it enters inlet chamber 21. At this point a pressure drop will exist between chamber 21 and chamber 17. This is sensed by the valve member 25 which moves in response to the pressure differential between the spring bias 26 combined with fluid pressure from first signal passage 28 and the pressure on the end of valve member 25 created by fluid pressure from second signal passage 29. When the pressure in passage 29 is great enough to overcome the combined spring and inlet pressure bias, the valve member 25 will shift to the left (viewing FIG. 1**) and will restrict the flow of oil, thereby maintaining the pressure in the whole valve structure.

In addition, I have shown in FIG. 1 an anticavitation valve feature which is formed by bore 30 in housing 20 parallel to bore 24 and also extending through both chambers 21 and 22. A floating ball 31 is provided within an enlarged chamber portion 32 of bore 30. This ball is normally held by pressure in chamber 21 against the end of bore 30 to prevent flow of fluid through bore 30, however, in the event of a pressure drop in chamber 21, the ball will open and fluid flow directly from the outlet chamber to the inlet chamber through bore 30. Alternatively, the ball 31 could be spring loaded to provide a relief check valve.

Figure 2:
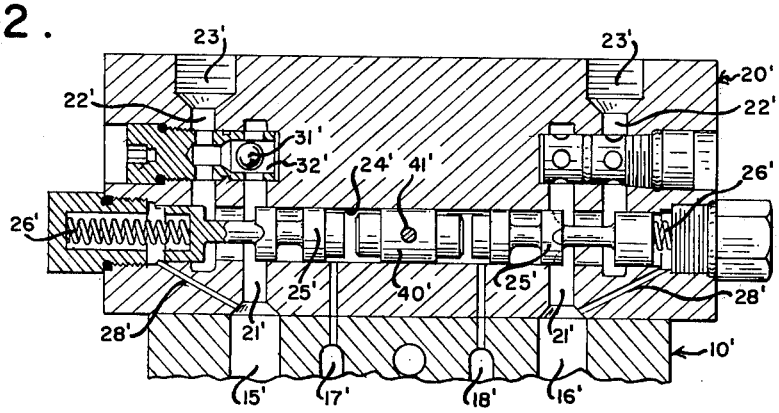
FIG. 2 is a sectional view through a second embodiment of compensator valve according to this invention.

In FIG. 2 I have illustrated a modification of this valve used on both work ports. The valve of FIG. 2 is essentially the same as that of FIG. 1 except for configuration of the parts and accordingly like parts have been given like numbers with a prime suffix. One major difference here is that bore 24' is extended through the full length of housing 20' and is blocked intermediate its ends by a plug 40' which may be held in place by a pin 41' or by some other means. In operation, each compensator portion operates precisely as described above in connection with FIG. 1.

Figure 3:
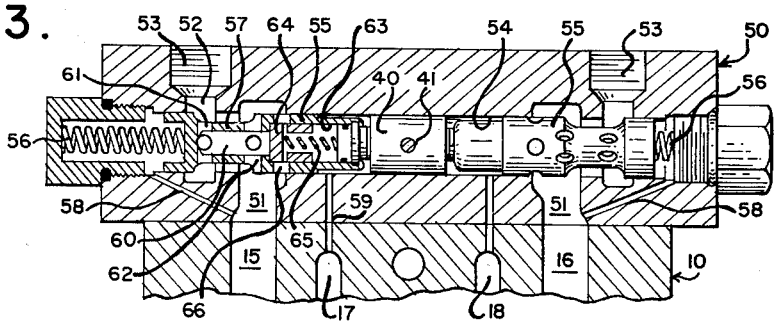
FIG. 3 is a sectional view through a third embodiment of compensator valve according to this invention.
Figure 4:
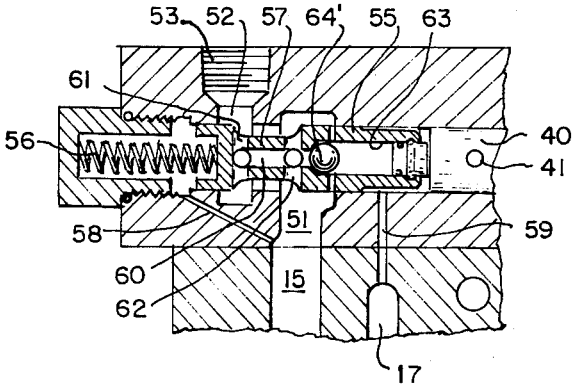
FIG. 4 is a fragmentary section of the embodiment of FIG. 3 using an anti-cavitation valve.

In FIG. 3 I have illustrated a second modification of my invention in which a compensator housing 50 has an inlet chamber 51 communicating with work port 15 of a closed center valve such as shown in FIG. 1 and a spaced outlet chamber 52 communicating with a threaded outlet port 53. A bore 54 extends through both chambers 51 and 52 and carries valve member 55 slidable therein. Valve member 55 is biased toward inlet chamber 51 by spring 56. An annular groove 57 is provided in valve member 55 intermediate its ends. A first signal passage 58 connects inlet chamber 51 with bore 54 at the end carrying spring 56. A second signal passage 59 connects high pressure chamber 17 to the end of bore 54 so that pressure in chamber 17 is applied to the end of valve member 55. Valve member 55 is provided with an axial bore 60 which communicates with the exterior of the valve member at the ends of annular groove 57 through radial passages 61 and 62. An enlarged bore 63 at the end of bore 60 carries a check valve 64, biased to closed position by spring 65. Radial passages 66 communicate from bore 63 through the walls of the valve member.

The operation of the valve of FIG. 3 is essentially the same as that of FIG. 1. The principal difference is in the fact that instead of a separate bore carrying a relief check, the relief check 64 is built into valve member 55. As in the case of FIG. 1, a floating ball 64' could be substituted for relief check 64 to provide an anti-cavitation function as there described.

In the foregoing specification I have described certain preferred embodiments and practices of my invention, however, it will be understood that this invention may be otherwise embodied within the scope of the following claims.

I claim:

1. A compensated work port fluid valve comprising a directional control valve having a housing with inlet and outlet ports, a bore extending through said housing, a valve member movable in said bore a first inlet chamber in the housing intersecting said bore and connected to the inlet port, a work chamber in said housing spaced from said first inlet chamber, an outlet chamber intersecting said bore, said work chamber being adapted to be connected to said first inlet chamber in one position of the valve member and to the outlet chamber in a second position of said valve member, a second bore in said housing, a second inlet chamber intersecting said second bore and connected to said work chamber, a second outlet chamber intersecting said second bore and spaced from said second inlet chamber, a work port connected to said second outlet chamber, a second valve member having an intermediate annular groove is movable in said second bore, resilient bias means urging said second valve member toward the second inlet chamber into a first position in which the second inlet chamber and second outlet chamber are in communication through the annular groove in the second valve member, a first signal passage connecting the second inlet chamber to the second bore at the resilient means whereby pressure fluid in the second inlet chamber supplements the resilient means in urging the second valve member into said first position and a second signal passage connecting the first inlet chamber with said second bore at the end opposite the resilient means whereby pressure fluid in the first inlet chamber acts on the end of the second valve member opposite the resilient means to urge the second valve member toward the second outlet chamber to reduce the flow of fluid around the groove in the second valve member whereby said second valve member is moved in the second bore in response to pressure differential between the first inlet chamber and the second inlet chamber to maintain a substantially constant pressure at the work port, anti-cavitation valve means connecting said second inlet and second outlet chambers, said anti-cavitation valve means being formed by an axial bore in the second valve member having spaced radial connections through the valve member side wall and valve means in said axial bore between said spaced radial connections movable in response to pressure differential between said chambers to permit flow from the second outlet to the second inlet chamber when the pressure in said second inlet chamber drops below that of the second outlet chamber.

2. A compensated work port fluid valve comprising a directional control valve having a housing with inlet and outlet ports, a bore extending through said housing, a valve member movable in said bore, a first inlet chamber intersecting said bore and connected to the inlet port, a work chamber spaced from said first inlet chamber, an outlet chamber intersecting said bore, said work chamber being adapted to be connected to said first inlet chamber in one position of the valve member and to the outlet chamber in a second position of said valve member, a second bore in said housing, a second inlet chamber intersecting said second bore and connected to said work chamber, a second outlet chamber intersecting said second bore and spaced from said second inlet chamber, a work port connected to said second outlet chamber, a second valve member having an intermediate annular groove is movable in said second bore, resilient bias means urging said second valve member toward the second inlet chamber into a first position in which the second inlet chamber and second outlet chamber are in communication through the annular groove in the second valve member, a first signal passage connecting the second inlet chamber to the second bore at the resilient means whereby pressure fluid in the second inlet chamber supplements the resilient means in urging the second valve member into said first position and a second signal passage connecting the first inlet chamber with said second bore at the end opposite the resilient means whereby pressure fluid in the first inlet chamber acts on the end of the second valve member opposite the resilient means to urge the second valve member toward the second outlet chamber to reduce the flow of fluid around the groove in the second valve member whereby said second valve member is moved in the second bore in response to pressure differential between the first inlet chamber and the second inlet chamber to maintain a substantially constant pressure at the work port, relief check valve means connecting said second inlet and second outlet chambers, said relief check valve means is formed by an axial bore in the second valve member having spaced radial connections through the valve member side wall and resilient biased valve means in said axial bore between said spaced radial passages adapted to open when the pressure in said second outlet chamber exceeds a preselected value.

3. A work port compensator valve adapted to be removably attached to a directional control valve having an inlet chamber, a work chamber and an outlet chamber comprising a housing having a compensator inlet chamber adapted to connect to the work chamber of the directional control valve, a compensator outlet chamber spaced from said compensator inlet chamber, a work port connected to said compensator outlet chamber, a bore connecting said compensator inlet and outlet chambers, a compensator valve member movable in said bore and having an annular groove intermediate its ends, resilient biasing means acting on said compensator valve member normally urging it toward the compensator inlet chamber to a first position in which the compensator inlet chamber and compensator outlet chamber, are in communication through the annular groove, a first signal passage connecting the compensator inlet chamber to the bore at the resilient means whereby pressure fluid in the compensator inlet chamber acts with the resilient means to maintain the compensator valve member in said first position and a second signal passage adapted to connect the inlet chamber of the directional control valve with said bore at the end opposite the resilient means whereby pressure fluid in the inlet chamber of the directional control valve is adapted to act on the end of the compensator valve member opposite the resilient means to urge the compensator valve member toward the compensator outlet chamber to reduce the flow of fluid around the groove in the compensator valve member whereby said compensator valve member is adapted to be moved in the bore in response to pressure differential between the inlet chamber of the directional control valve and the compensator inlet chamber to maintain a substantially constant pressure at the compensator work port, anti-cavitation valve means connecting said compensator inlet and outlet chambers, said anti-cavitation valve means being formed by an axial bore in the compensator valve member having spaced radial connections through the valve member side wall and valve means in said axial bore between said spaced radial connections movable in response to pressure differential between said chambers to permit flow from the compensator outlet to the compensator inlet chamber when the pressure in said compensator inlet chamber drops below that of the compensator outlet chamber.

4. A work port compensator valve adapted to be removably attached to a directional control valve having an inlet chamber, a work chamber and an outlet chamber comprising a housing having a compensator inlet chamber adapted to connect to the work chamber of the directional control valve, a compensator outlet chamber spaced from said compensator inlet chamber, a work port connected to said compensator outlet chamber, a bore connecting said compensator inlet and outlet chambers, a compensator valve member movable in said bore and having an annular groove intermediate its ends, resilient biasing means acting on said compensator valve member normally urging it toward the compensator inlet chamber to a first position in which the compensator inlet chamber and compensator outlet chamber are in communication through the annular groove, a first signal passage connecting the compensator inlet chamber to the bore at the resilient means whereby pressure fluid in the compensator inlet chamber acts with the resilient means to maintain the compensator valve member in said first position and a second signal passage adapted to connect the inlet chamber of the directional control valve with said bore at the end opposite the resilient means whereby pressure fluid in the inlet chamber of the directional control valve is adapted to act on the end of the compensator valve member opposite the resilient means to urge the compensator valve member toward the compensator outlet chamber to reduce the flow of fluid around the groove in the compensator valve member whereby said compensator valve member is adapted to be moved in the bore in response to pressure differential between the inlet chamber of the directional control valve and the compensator inlet chamber to maintain a substantially constant pressure at the compensator work port, relief check valve means connecting said compensator inlet and compensator outlet chambers, said relief check valve means being formed by an axial bore in the compensator valve member having spaced radial connections through the valve member side wall and resilient biased valve means in said axial bore between said spaced radial passages adapted to open when the pressure in said compensator outlet chamber exceeds a preselected value.

* * * * *